US012104450B2

(12) United States Patent
Sutton

(10) Patent No.: US 12,104,450 B2
(45) Date of Patent: Oct. 1, 2024

(54) SAFETY PLUG

(71) Applicant: Rattlejack Innovations Pty Ltd, Logan (AU)

(72) Inventor: Leigh Maurice Sutton, Logan (AU)

(73) Assignee: Rattlejack Innovations Pty Ltd, Logan (AU)

( * ) Notice: Subject to any disclaimer, the term of this patent is extended or adjusted under 35 U.S.C. 154(b) by 0 days.

(21) Appl. No.: 18/016,270

(22) PCT Filed: Jul. 14, 2021

(86) PCT No.: PCT/AU2021/050755

§ 371 (c)(1),
(2) Date: Jan. 13, 2023

(87) PCT Pub. No.: WO2022/011421

PCT Pub. Date: Jan. 20, 2022

(65) Prior Publication Data

US 2023/0265738 A1 Aug. 24, 2023

(30) Foreign Application Priority Data

Jul. 14, 2020 (AU) ..... 2020902419
Jul. 20, 2020 (AU) ..... 2020902512

(51) Int. Cl.
*E21B 33/128* (2006.01)
*E21B 23/02* (2006.01)
(Continued)

(52) U.S. Cl.
CPC ..... *E21B 33/128* (2013.01); *E21B 23/02* (2013.01); *E21B 33/1293* (2013.01); *E21B 41/0021* (2013.01); *E21D 21/0026* (2013.01)

(58) Field of Classification Search
CPC ..... E21B 33/1293; E21B 41/0021; E21B 33/128; E21B 23/02; E21D 21/0026; E21F 11/00; F42D 1/18
See application file for complete search history.

(56) References Cited

U.S. PATENT DOCUMENTS

| | | | |
|---|---|---|---|
| 3,394,627 | A | 7/1968 | Metcalfe |
| 9,845,658 | B1 | 12/2017 | Nish et al. |
| 2019/0048681 | A1 | 2/2019 | Sutton |

FOREIGN PATENT DOCUMENTS

| | | | |
|---|---|---|---|
| CN | 204085346 | U | 1/2015 |
| CN | 109520386 | A | 3/2019 |

(Continued)

OTHER PUBLICATIONS

International Search Report and Written Opinion; Application No. PCT/AU2021/050755; mailed Sep. 20, 2021.

*Primary Examiner* — Yong-Suk (Philip) Ro
(74) *Attorney, Agent, or Firm* — Fitch, Even, Tabin & Flannery, LLP

(57) ABSTRACT

A safety plug for use in a bore hole comprising a bore wall. The safety plug comprises a body having a leading end and a trailing end, and at least one flared portion. An anchoring element extends at least partially around an associated flared portion. Axially displacement of anchoring element relative to its associated flared portion causes the anchoring element to bear against the flared portion and transitions the anchoring element between an unexpanded condition and an expanded condition. A nose, comprising conical elements, extends longitudinally from the leading end of body. The nose is longitudinally compressible.

20 Claims, 12 Drawing Sheets

(51) Int. Cl.

| | |
|---|---|
| ***E21B 33/129*** | (2006.01) |
| ***E21B 41/00*** | (2006.01) |
| ***E21D 21/00*** | (2006.01) |

(56) References Cited

FOREIGN PATENT DOCUMENTS

| | | | | | |
|---|---|---|---|---|---|
| SU | 1065616 | A | | 1/1984 | |
| WO | 1995/026457 | A1 | | 10/1995 | |
| WO | 2019/209336 | A1 | | 10/2019 | |
| ZA | 9408688 | | * | 9/1995 | ..... E21D 21/008 |

* cited by examiner (a)

(b)

(c)

(d)

(e)

(f)

SAFETY PLUG

CROSS-REFERENCE TO RELATED APPLICATIONS

The present application is a U.S. national phase application filed under 35 U.S.C. § 371 of International Application Number PCT/AU2021/050755 filed Jul. 14, 2021 designating the United States, which claims priority from Australian Provisional Patent Application No 2020902419 filed on 14 Jul. 2020 and Australian Provisional Patent Application No 2020902512 filed on 20 Jul. 2020, the contents of which are incorporated herein by reference in their entirety.

TECHNICAL FIELD

The present disclosure relates, generally, to a safety apparatus for bore holes and, more particularly, to a safety plug for use in a bore hole.

BACKGROUND

Drill strings are used in the mining industry to drill long bores into rock strata for various reasons. Once the bore is drilled, the drill rods are removed so that explosives can be packed into the bore. The drill rods are removed by progressively withdrawing them from the bore and disconnecting each drill rod as it exits the bore. From time to time, drill rods can become bogged or stuck within a bore. This can occur either during drilling of the bore or during retrieval of the drill rods from the bore. While in some instances the drill rods can be dislodged from a bogged or stuck condition and can therefore be retrieved, in other instances, the drill rods become so bogged or stuck that their retrieval is not possible. In those circumstances, it is often the case that there are two or three rods left within a bore.

This presents an obvious safety issue should the rods subsequently become loose or free within the bore allowing them to fall out of the bore. If one or more drill rods were to exit a bore in this manner, any personnel or equipment standing under the open end of the bore could be struck with potentially catastrophic results.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each of the appended claims.

SUMMARY

In a first aspect of the present disclosure, there is provided a safety plug for use in a bore hole comprising a bore wall, the safety plug comprising: a body defining a leading end and a trailing end, the body comprising at least one flared portion, the at least one flared portion flaring outwardly from the trailing end to the leading end of the body; and an anchoring element associated with the at least one flared portion of the body, the anchoring element being axially displaceable relative to the flared portion for transitioning between an inactive condition and an active, progressively laterally expanded condition in which the anchoring element is configured to engage the bore wall to resist axial displacement of the body relative to the bore hole.

The body may be elongate and comprise a plurality of axially aligned, flared portions, each flared portion flaring outwardly towards the leading end of the body to define a flared end; and an anchoring element associated with each flared portion of the body. The body may further comprise a retaining formation proximate the trailing end, and the anchoring element associated with a flared portion adjacent the trailing end, in its inactive condition, may abut the retaining formation and the anchoring element of each remaining flared portion, in its inactive condition, may abut the flared end of a trailing flared portion.

Each anchoring element may be a radially expansible annular element arranged about its associated flared portion. Each annular element may be a split ring of a resiliently deformable material, each annular element having a roughened outer surface to resist axial displacement relative to the bore wall. Each split ring may comprise crenellations arranged at a leading side of the split ring. The crenellations may be tapered inwardly towards the body for reducing a contact area between each split ring and its associated flared portion. The crenellations may be configured to deform radially outwardly.

The leading end of the body may comprise a mounting formation and the safety plug may further comprise at least one expander element carried by the mounting formation of the body, the at least one expander element being operable to transition between an inactive condition and an active, laterally expanded condition, the at least one expander element in the active, laterally expanded condition being configured to at least partially absorb a load applied to the leading end of the body. The at least one expander element may comprise a conical body member, the conical body member defining an axially extending slot to facilitate the transition to the active, laterally expanded condition.

In an embodiment, the safety plug may comprise a plurality of expander elements, each expander element comprising a conical body member with the conical body members being arranged in a nested configuration at the leading end of the body. Adjacent nested conical body members may carry a locking arrangement comprising cooperating locking formations for interlocking the plurality of nested conical body members in their inactive condition.

The mounting formation may comprise an elongate member extending from the leading end of the body, and the, or each, expander element may be a wedge-shaped member arranged about the elongate member.

The load applied to the leading end of the body may act to transition the at least one anchoring element to the active, progressively laterally expanded condition prior to the at least one expander element transitioning to the active, laterally expanded condition, in use.

In another aspect of the present disclosure, there is provided a safety plug for use in a bore hole comprising a bore wall, the safety plug comprising: a resiliently deformable body configured to be fixedly inserted into the bore hole via an interference fit with the bore wall, the body having a tapered leading end and defining a transitioning mechanism to facilitate transitioning of the body from an inactive, insertion configuration to an, active, laterally expanded configuration.

In another aspect, there is disclosed a safety plug for use in a bore hole comprising a bore wall, the safety plug comprising:

a body having a leading end and a trailing end, the body comprising at least one flared portion, the at least one flared portion flaring outwardly in a direction from the trailing end to the leading end of the body, the body defining a longitudinal axis extending centrally therethrough between the leading end and the trailing end;

an anchoring element extending at least partially around the least one flared portion of the body, the anchoring element being axially displaceable relative to the flared portion for transitioning the anchoring element, as a result of the anchoring element bearing against the at least one flared portion, between an unexpanded condition in which the anchoring element is closer to the longitudinal axis and an expanded condition in which the anchoring element is further from the longitudinal axis; and a nose extending longitudinally from the leading end of the body, the nose being longitudinally compressible.

The nose may be longitudinally compressible and laterally expansible.

In some embodiments, the at least one flared portion comprises a plurality thereof, the flared portions being aligned on the longitudinal axis; and each of the flared portions has an associated said anchoring element. In some embodiments, the body further comprises a retaining formation proximate the trailing end for abutment by the anchoring element associated with the flared portion closest the trailing end to retain that anchoring element in a position forwardly of the retaining formation, and wherein abutment of each of the other anchoring elements with a flared end of an adjacent, trailing said flared portion retains each of the other anchoring elements in a position forwardly of its associated adjacent, trailing said flared portion.

In some embodiments, each said anchoring element is a radially expansible annular element. Each said annular element may be a split ring of a resiliently deformable material. Each said anchoring element may comprise crenellations arranged at a leading end thereof. The leading end of each of the crenellations may be tapered inwardly. The crenellations may be configured to splay outwardly in response to axial displacement of the anchoring element toward a leading end of the associated flared portion.

The nose may be operable to transition between an inactive condition and an active condition to at least partially absorb a force applied to a leading end of the safety plug, a length of the nose being lesser and a width of the nose being greater in the active condition than in the inactive condition.

The nose may comprise a conical body member. An axially extending slot may be provided in the conical body member to facilitate lateral expansion of the conical body member. The safety plug may comprise a plurality of the conical body members, the conical body members being arranged in a nested configuration at the leading end of the body. The conical body members may have cooperating locking formations for releasably interlocking the plurality of nested conical body members against axial displacement relative to one another. The cooperating locking formations may be configured to disengage in response to application of a compressive force to the nose. The safety plug may be configured such that, prior to the cooperating locking formations disengaging, each said anchoring element is configured to commence displacement toward a leading end of the associated flared portion in response to the application of the compressive force to the nose.

The safety plug may be configured such that, with the anchoring element(s) restrained against displacement along the longitudinal axis but free to expand laterally, application of a compressive force to the nose initiates expansion of the anchoring element(s) before initiating compression of the nose.

Each said anchoring element and each said flared portion may be of a harder material than the nose.

Each said anchoring element and each said flared portion may be of a hard material, such as a material having a Rockwell hardness of approximately M88.

The nose may be of a medium soft material, such as a material having a Shore hardness of approximately A90.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

BRIEF DESCRIPTION OF DRAWINGS

Embodiments of the disclosure will now be described by way of example only with reference to the accompanying drawings in which.

DESCRIPTION OF EMBODIMENTS

Figure 1:
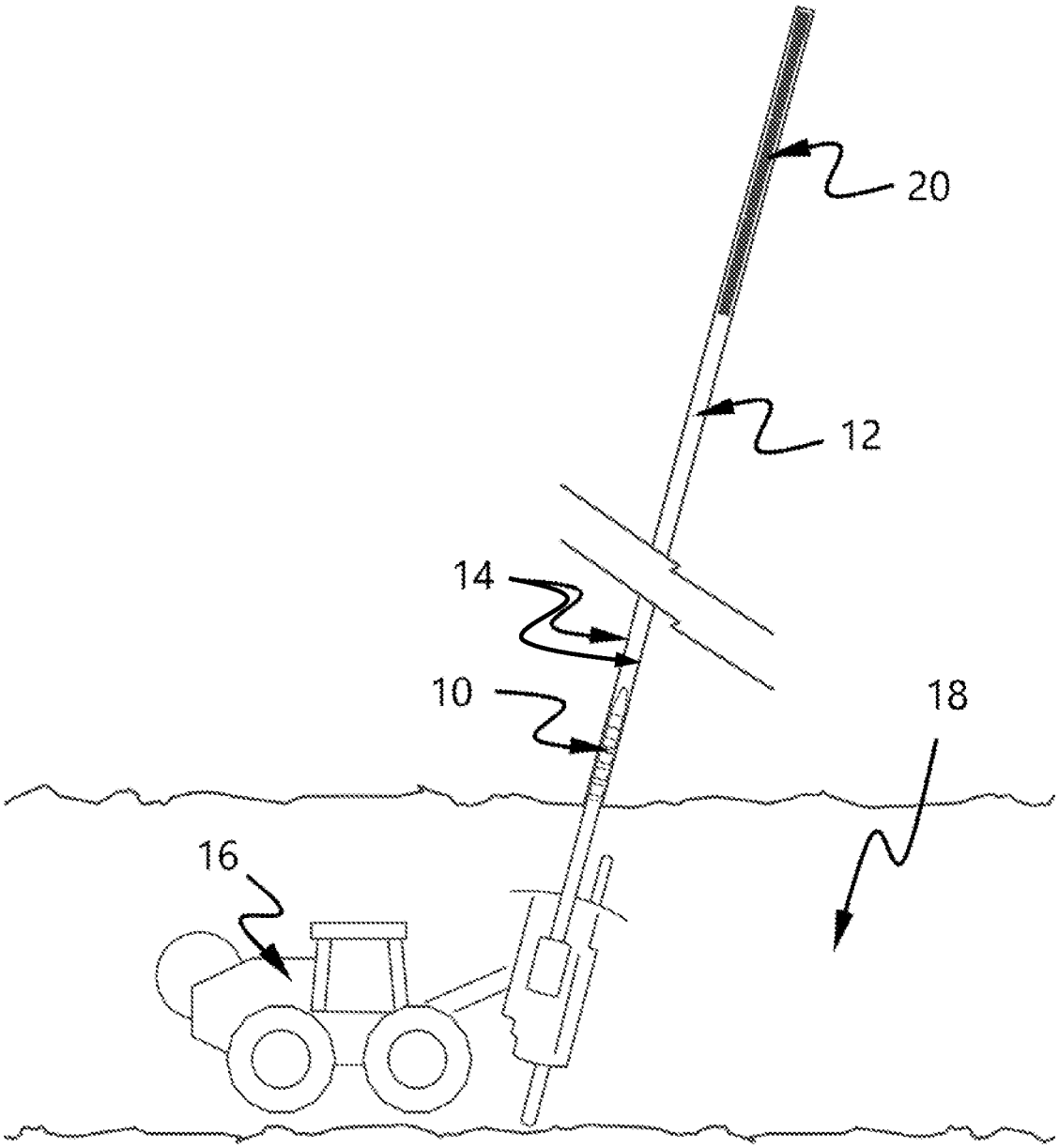
FIG. 1 shows an exemplary embodiment of a drilling machine installing an embodiment of a safety plug into a bore hole.

In the drawings, reference numeral 10 generally designates an embodiment of a safety plug for use in a bore hole 12 comprising a bore wall 14. FIG. 1 shows a drilling machine 16 in an underground passage 18 installing the safety plug 10 into the bore hole 12 for inhibiting egress of a stuck drill rod 20 from the bore hole 12 to minimise the danger of the falling drill rod 20 striking personnel or equipment (not shown) in the underground passage 18.

Figure 2:
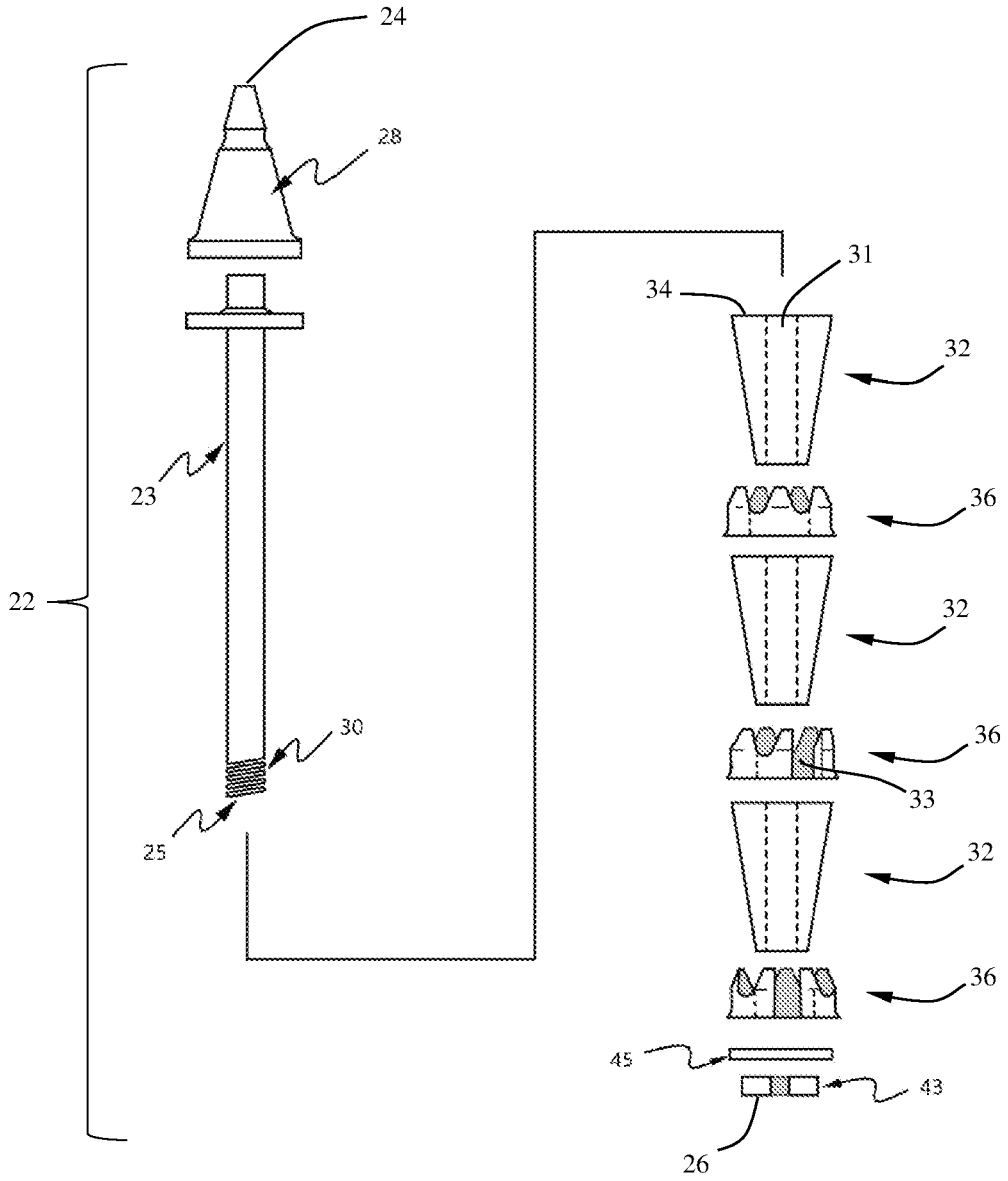
FIG. 2 shows an exploded view of a first embodiment of a body of the safety plug shown in FIG. 1, with a first embodiment of an anchoring element associated with each flared portion of the body.

FIG. 2 shows a body 22 of the safety plug 10 in more detail. The body 22 defines a leading end 24 and a trailing end 26, with a mounting formation in the form of a conical element 28 provided at the leading end 24. The conical element 28 is carried on a leading end of shank 23. Shank 23 has a threaded portion 30 at its trailing end 25.

The body 22 of the safety plug 10 comprises a plurality of axially aligned, flared portions 32 arranged in end-on abutting relationship. Each flared portion 32 flares outwardly towards the leading end 24 of the body 22 to define a flared leading end 34. In this embodiment, each flared portion 32 of the body 22 defines a passage 31 through which the shank 23 extends to mount the flared portions 32 on the shank 23. The body 22 of the safety plug 10 further includes a retaining arrangement in the form of a retaining washer 45 and threaded nut 43, which are secured to the threaded portion 30 at the trailing end 25 of the shank 23 to retain the flared portions on the shank 23. It will be appreciated that, in another embodiment (not shown), the flared portions 32 may be of unitary, one piece construction with each other and, in some embodiments, with the shank 23.

The safety plug 10 further comprises an anchoring elements in the form of annular elements, more specifically, split rings 36, each split ring 36 being axially slidably mounted on a respective flared portion 32. Each split ring 36 is radially expansible and has an inner surface that defines a seat 33 for engagement with the conical surface of the respective flared portion 32. Axial displacement of split ring 36 from the trailing end toward the leading end of its associated flared portion 32 transitions split ring 36 from an inactive, installation condition (FIG. 10) to an active, expanded condition 40 (FIGS. 11 and 12) due to the increasing diameter of the flared portion 32 progressively laterally expending the split ring 36. If the safety plug 10 is struck by a falling drill rod 20, this progressive lateral expansion of split ring 36 causes the split ring 36 to progressively engage the bore wall 14 to control and then resist axial displacement of the body 22 relative to the bore hole 12. It will be appreciated that, in other embodiments, the body of the safety plug 10 may include a single flared portion 32, with a single split ring 36 slidably mounted thereon, and/or multiple split rings 36 may be provided on a single flared portion 32. It will also be appreciated that the or each split ring 36 may be substituted with a different form of anchoring element, such as a resiliently expansible ring without a split.

Each flared portion 32 and each anchoring element 36 is of a hard material which is able to withstand high impacts, such as a suitable synthetic plastics material. Each flared portion 32 and each anchoring element 36 being of a hard material also contributes to reduced friction between these components. In an embodiment, each flared portion 32 and each split ring 36 is of an engineering plastics material, such as a high density polyamide, which is abrasion resistant, resistant to compression but has flexibility. For example, each flared portion 32 and each split ring 36 may be of 'Nylon 6' having a Rockwell hardness of M88. Further, each split ring 36 has a roughened outer surface to enhance frictional engagement with the bore wall 14 as shown schematically by arrows 37 in FIG. 7, and thereby to provide enhanced resistance to axial displacement relative to the bore wall 14. The inner surface of each split ring 36 is smooth to minimise friction between the split ring and associated flared portion 32, thereby to facilitate axial displacement of the flared portion 32 and its associated split ring 36 relative to each other.

Traversal of the split ring 36 towards the leading end 34 of its associated flared portion 32 causes the split ring 36 to expand and become wedged between its associated flared portion and the bore wall 14. thereby This wedging action inhibits axial displacement of the body 22 of safety plug 10 towards an opening of the bore hole 12 in response to an applied load 51 (FIG. 11) imparted by the falling drill rod 20.

Figure 3:
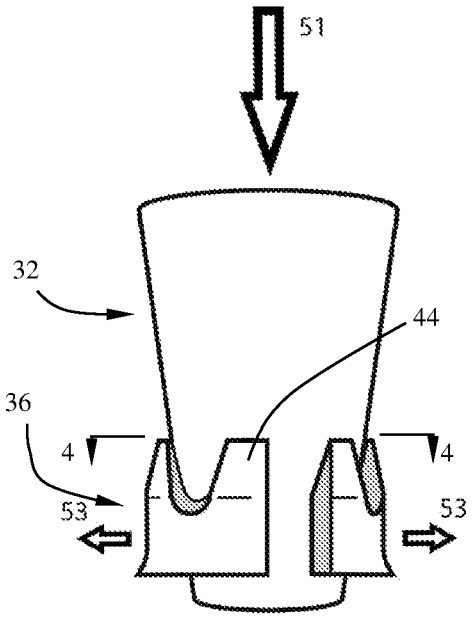
FIG. 3 shows an anchoring element and associated flared portion of the safety plug body of FIG. 2, the anchoring element being shown in an intermediate, partially expanded condition.
Figure 5:
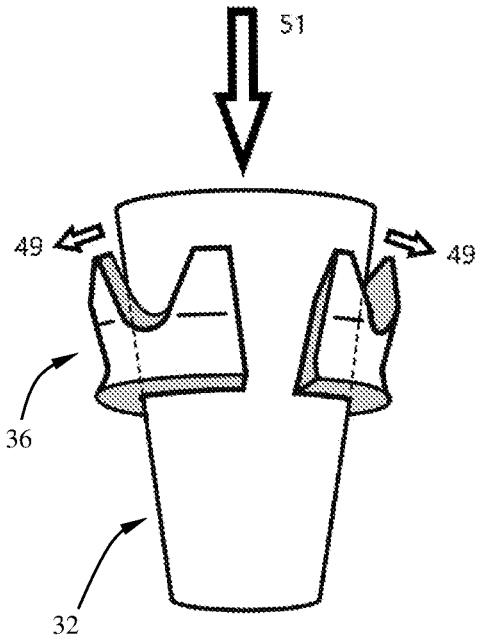
FIG. 5 shows the anchoring element and associated flared portion of FIG. 3, the anchoring element being shown in a laterally expanded, operative condition.
Figure 4:
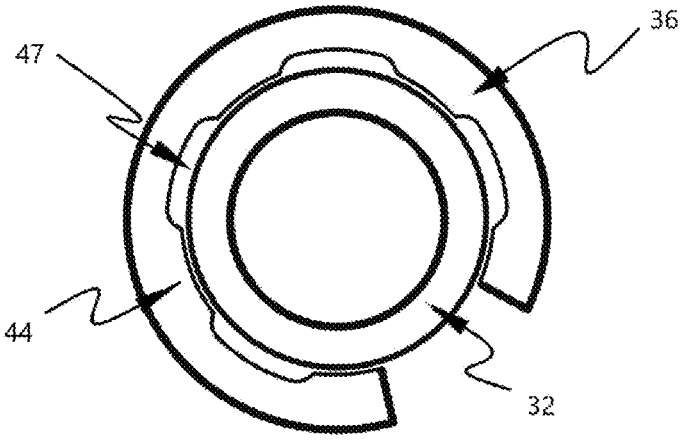
FIG. 4 shows a cross sectional view taken along line 4-4 of FIG. 3.

In an embodiment, and as shown in FIGS. 3-5, each split ring 36 may also include crenellations 44 for providing a reduced contact area between an inner surface of the split ring 36 and the associated flared portion 32. The crenellations 44 taper inwardly towards the leading end of the associated flared portion 32. Gaps 47 are defined between the inner surface of the split ring 36 and the associated flared portion 32. The reduced contact area facilitates the progressive transition of the split ring 36 to the active, expanded condition 40 by reducing friction between the split ring 36 and flared portion 32, and thereby reducing the likelihood of the split ring 36 jamming as it traverses the flared portion 32 in response to the load 51 imparted to the leading end 24 of the body 22 by the falling drill rod 20. Expansion of split ring 36 causes increased frictional engagement between the split ring 36 and the bore wall 14, as shown by arrows 53 in FIGS. 11 and 12. As the split ring 36 traverses towards the leading end of flared portion 32, the crenellations 44 deform outwardly away from the flared portion 32 of the body 22, as shown by arrows 49 in FIG. 5, and the contact area between the inner surface 41 of the split ring 36 and the flared portion 32 increases. It will be appreciated by the person skilled in the art that there are various suitable shapes of the anchoring element which can be utilised to provide these advantages.

Figure 17:
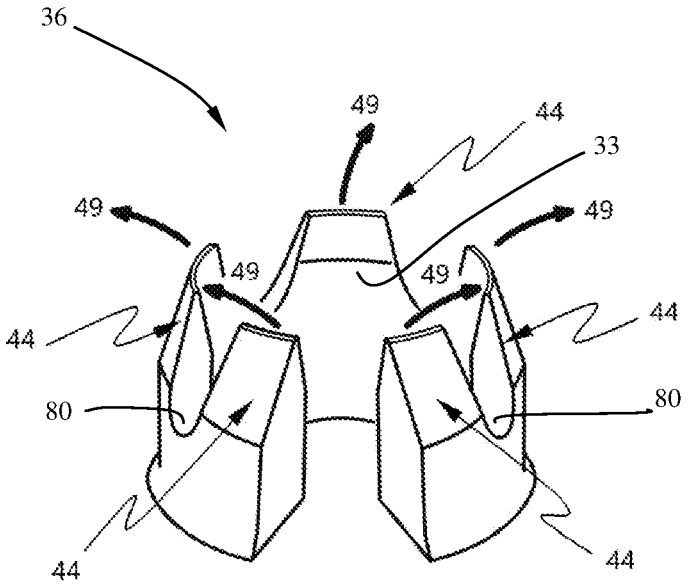
FIG. 17 shows a perspective view the anchoring element of FIG. 15 in an operative, expanded condition.
Figure 15:
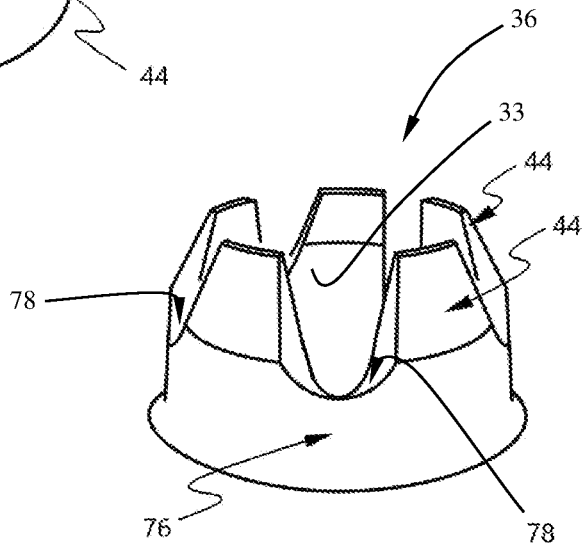
FIG. 15 shows a perspective view of an anchoring element of the safety plug body of FIG. 2, the anchoring element being shown in an inoperative, unexpanded condition.
Figure 16:
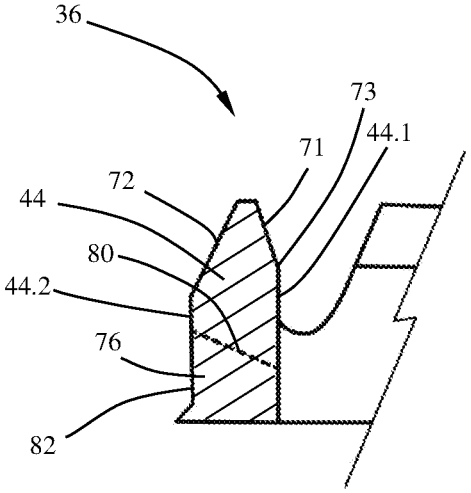
FIG. 16 shows a partial longitudinal cross-sectional view of the anchoring element of FIG. 15, the cross-sectional plane passing through one of the crenellations of the anchoring element.

An embodiment of split ring 36 will now be described in detail with reference to FIGS. 15-18. In FIGS. 15-17, unless indicated otherwise, reference numerals corresponding with those used in FIGS. 1-14 indicate corresponding parts with corresponding functionality.

Split ring 36 has an annular part 76 carrying a plurality of circumferentially spaced crenellations 44. Each crenellation 44 has an operatively inner side 44.1, being the side which faces the associated flared portion 32 of the body 22, and an operatively outer side 44.2, being the side which faces the wall of the bore hole 12. The inner side 44.1 has a first taper 71 and outer side 44.2 has a second taper 72. The tapers 71 and 72 are asymmetrical, with the taper 71 being shorter than the taper 72, which facilitates outward deformation of the crenellations 44 as the split ring 36 moves from the trailing end to the leading end of its associated flared portion 32 in response to safety plug 10 being impacted by a falling drill rod. In the configuration shown in FIG. 15 and in FIG. 18(*a*) to (*d*), an angle of the taper 71 is greater than that of the flared portion 32. The inner surface of annular part 76 is also non-parallel to the outer surface of flared portion 32. For example, the angle of taper 71 may be about 10° and that of the flared portion 32 may be about 6°. Accordingly, after installation in bore hole 12 but prior to impact and by a falling drill rod, and initially after impact by a falling drill rod, the split ring 36 only bears against the surface of the flared portion 32 at location 73. By providing line contact between the split ring 36 and the flared portion 32 at location 73, friction therebetween is reduced, which facilitates displacement of the split ring 36 from the trailing end to the leading end of the flared portion 32.

The annular part 76 of the split ring 36 between adjacent crenellations 44 is radiused, defining smoothly curved transition portions 78. The smoothly curved transition portions 78 inhibit stress fractures between adjacent crenellations 44. In addition, the transition portions 78 define a surface 80 which is angled downwardly from an operatively outer wall 82 of the annular part 76 to the operatively inner wall 74 of the annular part 76. The angling of surface 80 facilitates outward deformation of the crenellations 44 as the split ring 36 moves from the trailing end to the leading end of its associated flared portion 32 in response to the safety plug 10 being impacted by a falling drill rod. An included angle between surface 80 of split ring 36 and the longitudinal axis of the associated flared portion 32 is between about 60° and about 90°, typically being about 70°.

In an embodiment in which the annular part 76 of the split ring 36 has an outer diameter of approximately 90 mm and a height of the split ring 36 from its trailing end to its leading end is about 40 mm, the transition portions 78 may have a radius of about 11 mm.

Referring again to FIG. 2 of the drawings, the nut 43 and the washer 45 attached to the threaded portion 30 act as a retaining formation for the split ring 36 associated with the flared portion 32 adjacent the trailing end 26 of the body 22. The split ring 36 associated with the flared portion 32 at the trailing and 26 of the body 22 abuts against the washer 45 when that split ring 36 is in its inactive condition. In its inactive condition, each of the remaining split rings 36 is retained on its associated flared portion 32 by abutting the flared end 34 of the trailing flared portion 32.

In an embodiment, the body 22 of the safety plug 10 can be used on its own to inhibit displacement of a stuck drill rod 20. In such an embodiment, the body 22 may be driven into the bore hole 12 until the conical element 28 of the safety plug 10 abuts the proximal end of the stuck drill rod 20.

Figure 6:
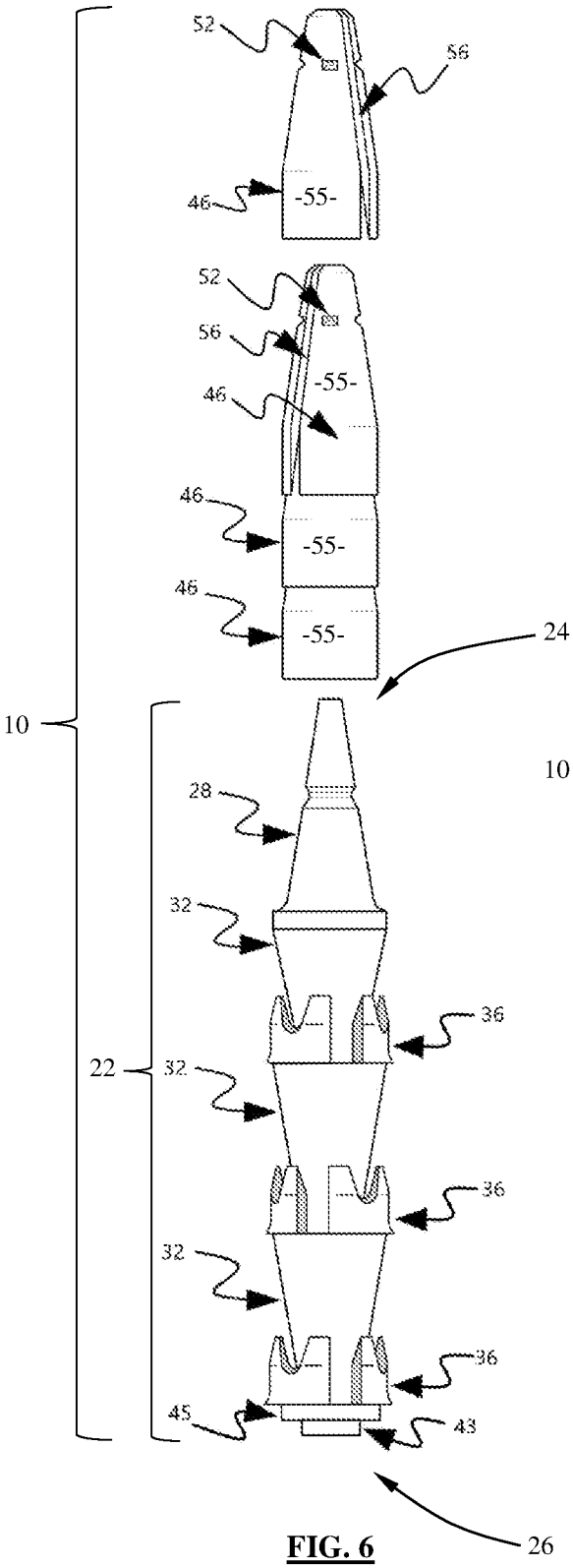
FIG. 6 shows a partially exploded view of a first embodiment of a safety plug including the safety plug body of FIG. 2 and a plurality of expander elements for mounting to a leading end thereof.
Figure 7:
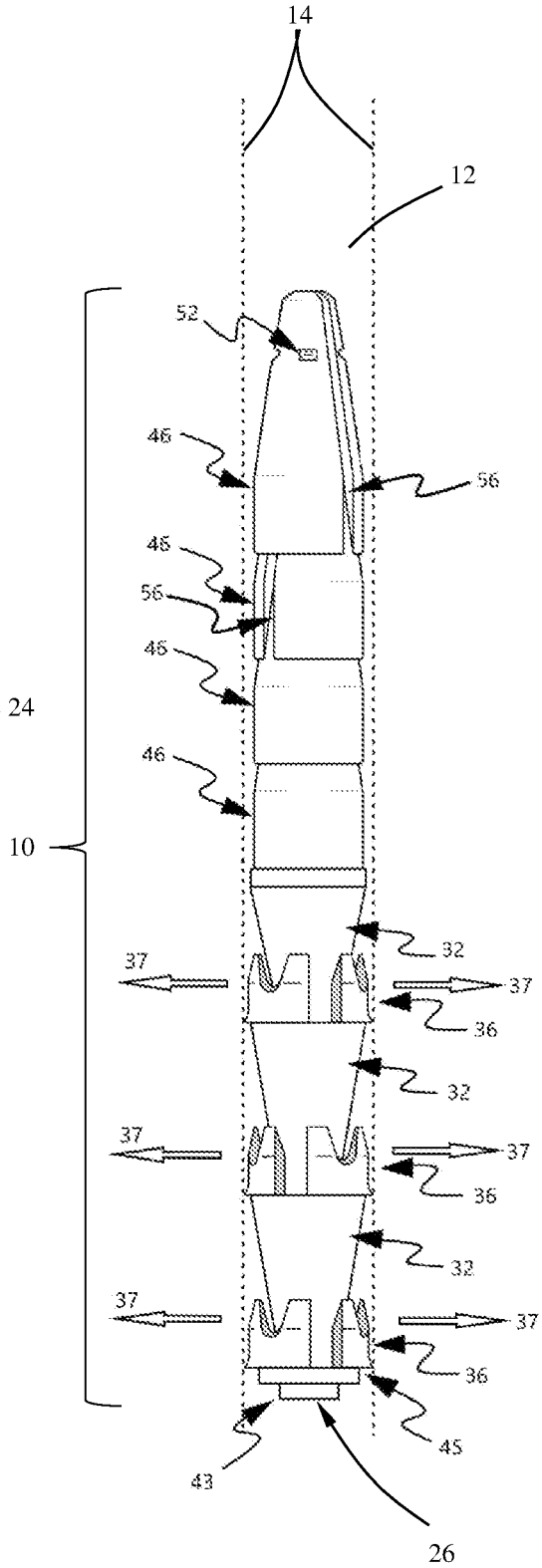
FIG. 7 shows the safety plug of FIG. 6, with the expander elements shown mounted to the safety plug body.
Figure 8:
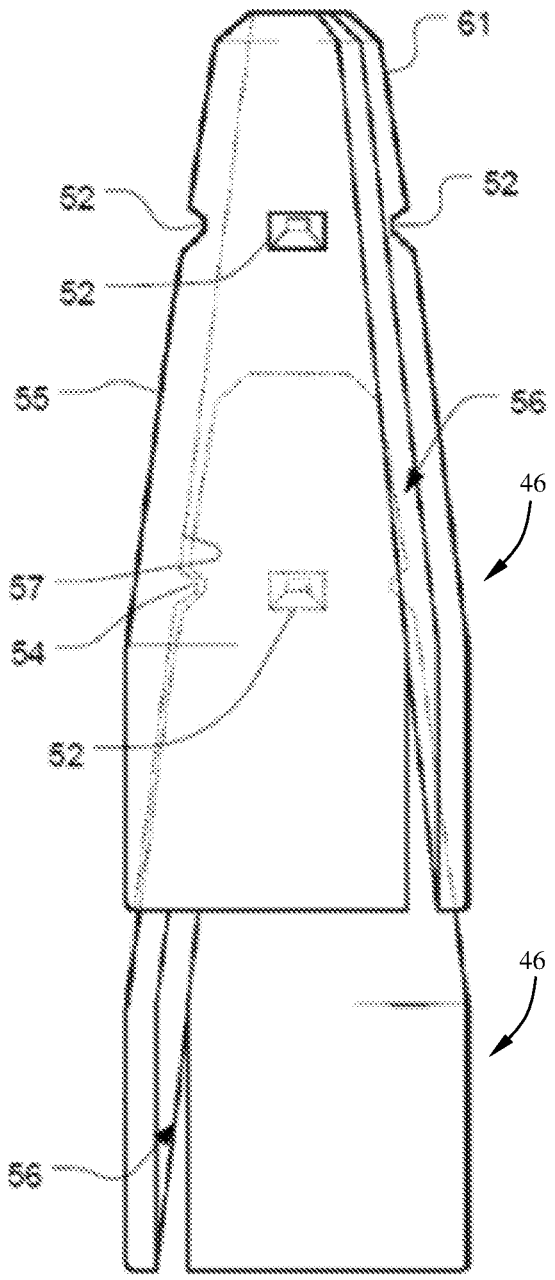
FIG. 8 shows a pair of the expander elements of the safety plug of FIG. 6.

More typically, as shown in FIGS. 6 and 7, the safety plug 10 includes the body 22 together with a plurality of expander elements, each in the form of a conical body member 46. The conical body members 46 define a nose of the safety plug 10 and are mountable to the conical element 28 of body 22. As shown in FIG. 6 of the drawings, the conical body members 46 are nested together prior to being mounted to the body 22. Each conical body member 46 is of a medium soft material, such as a resiliently flexible, synthetic plastics material. As an example, each conical body member 46 is of a polyurethane having a Shore Hardness of A90. The conical body members 46 being of a medium soft material contributes to enhanced friction between the conical body members and the drill rod 20. Each conical body member 46 being of a material softer than that of the each flared portion 32 and anchoring element 36 also contributes to the conical body members 46 undergoing significant plastic deformation in response to impact by a falling drill rod 20, and thereby absorbing a significant amount of energy from the falling drill rod to reduce its speed, and the anchoring elements 36 and conical body members responding relatively elastically to the falling drill rod.

Figure 10:
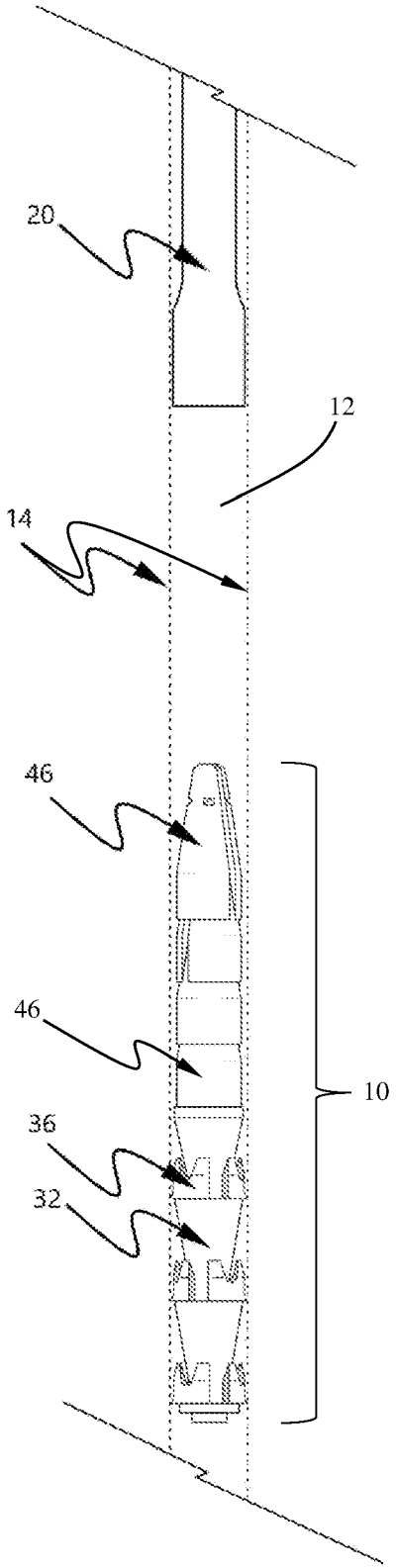
FIG. 10 shows a the safety plug of FIG. 6 in use, prior to being struck by a falling drill rod.
Figure 11:
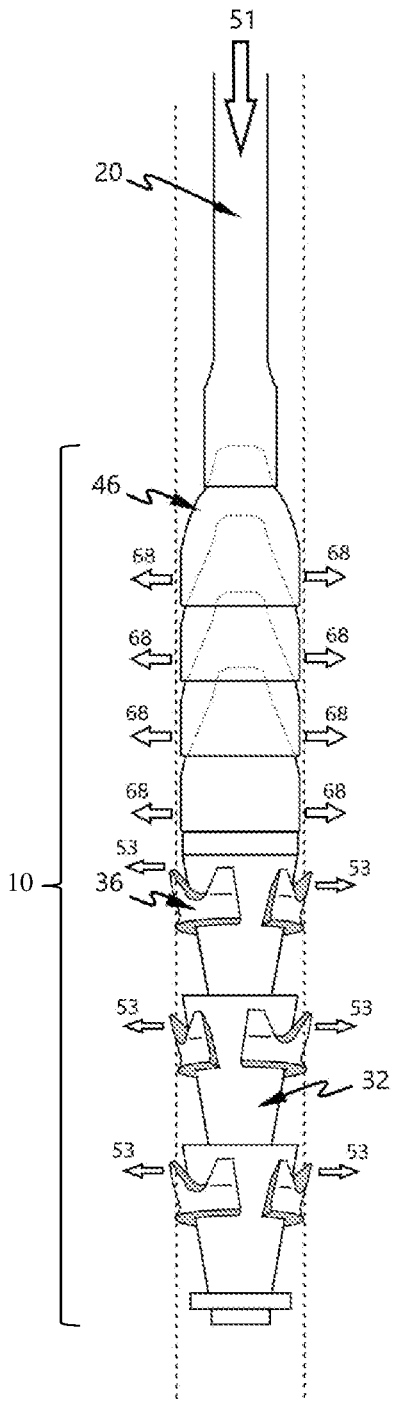
FIG. 11 shows the safety plug of FIG. 10 after the falling drill rod shown in FIG. 10 has struck the safety plug, the safety plug body has adopted its locking configuration and the expander elements have partially deformed to absorb the forces imparted by the falling drilling rod.
Figure 12:
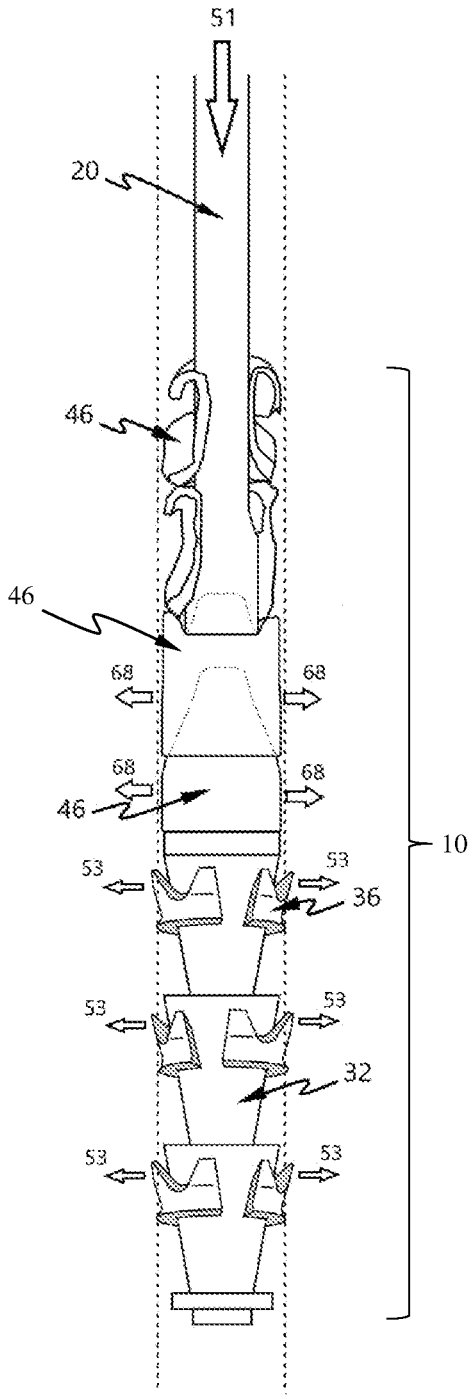
FIG. 12 shows the safety plug of FIGS. 10 and 11 after movement of the falling drill rod has been halted by deformation of the expander elements.

As will be described in greater detail below, the nested conical body members 46 are operable to transition between an inactive condition (FIGS. 7, 10) and an active, laterally expanded, deformed condition (FIGS. 11, 12). The conical body members 46 are arranged in a nested configuration and are carried by the conical element 28 at the leading end 24 of the body 22. Each pair of nested conical body members 46 carries a locking arrangement 52, 54 which facilitates retention of the conical body members 46 relative to each other when the safety plug 10 is being inserted into the bore hole 12. Further, each conical body member 46 defines an axially extending slot 56 to facilitate the transition to the active, laterally expanded condition, as shown in FIGS. 11 and 12.

The locking arrangement 52, 54 may adopt various forms. In the embodiment shown in FIG. 8, the locking arrangement of each pair of nested conical body members 46 comprises a plurality of circumferentially spaced sockets 52 extending radially inwardly from an outer surface 55 of each conical body member 46, proximately of its leading end 61. Correspondingly shaped radially inwardly extending projections 54 are arranged on an inner surface 57 of each conical body member 46, with the sockets 52 and projections 54 of adjacent conical body members 46 forming cooperating locking formations for releasably interlocking the conical body members 46 in their inactive condition.

Figure 9:
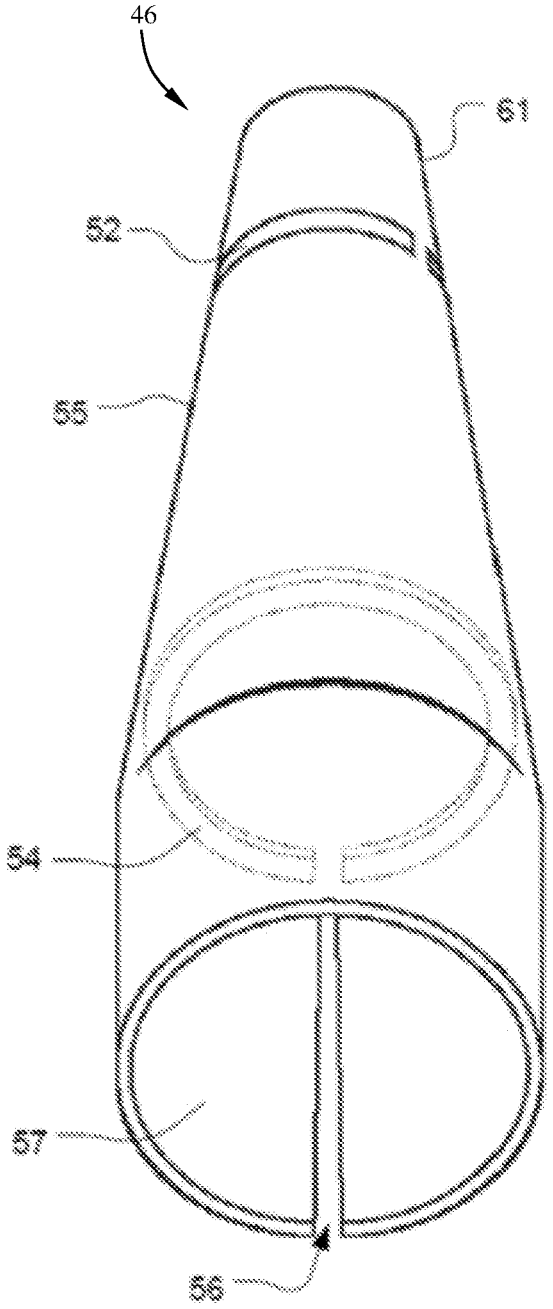
FIG. 9 shows an alternative embodiment of expander elements for connection to the leading end of the safety plug body of FIG. 2.

In the embodiment shown in FIG. 9, the locking arrangement of each pair of nested conical body members 46 comprises an annular groove 52 arranged proximately of the leading end 61 of each conical body member 46. A radially inwardly extending annular element 54 is carried within each conical body member 46, the annular element 54 releasably engaging the groove 52 of the conical body member 46 nested within.

Figure 13:
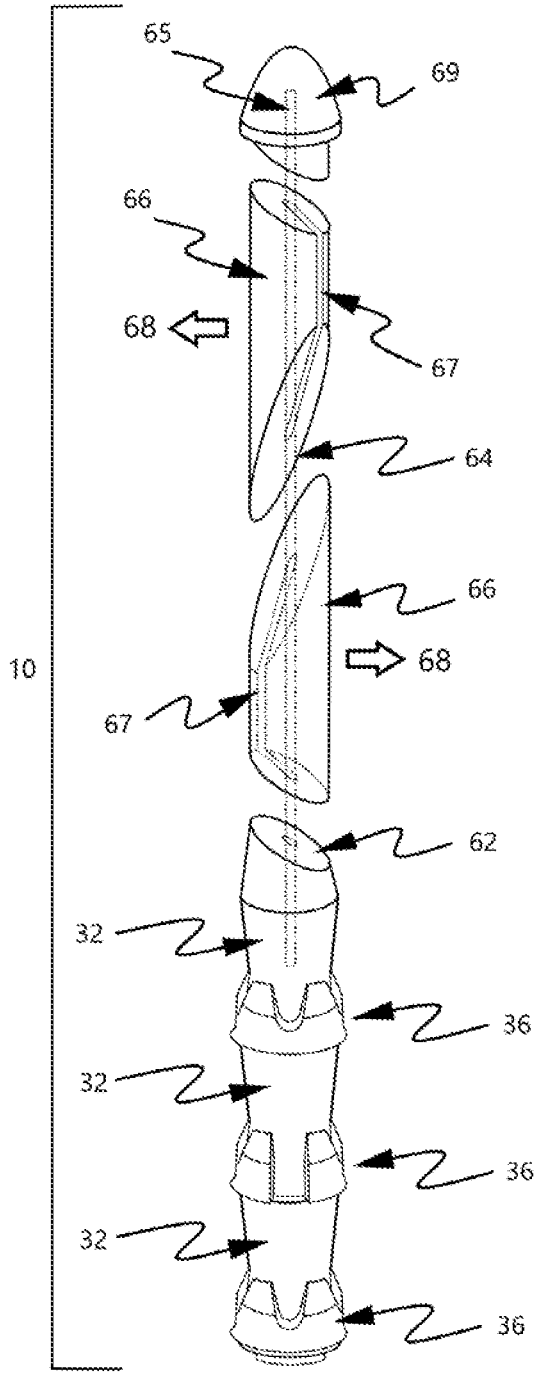
FIG. 13 shows a further embodiment of expander elements mounted to the safety plug body of FIG. 2.

In an alternate embodiment of the safety plug 10, as shown in FIG. 13, the conical element 28 is replaced by a mounting formation that includes a mounting block 62 mounting a rod 64. The mounting block 62 has an angled surface from which the rod 64 extends distally from the leading end 24 of the body 22. In this embodiment, each expander element is in the form of a wedge-shaped member 66 defining an axially extending slot 67 and arranged about the rod 64. A conical member 69 is arranged at a leading end 65 of the rod 64. The wedge-shaped members 66 are operable to transition between an inactive condition, in which they are axially aligned, and an active, expanded condition (not shown) in which the wedge-shaped members 66 are laterally displaced relative to each other. In the active, laterally expanded condition, the wedge-shaped members 66 are configured to absorb a substantial part of load applied to the leading end 24 of the body 22 when the safety plug 10 is struck by the falling drill rod 20.

In use, the safety plug 10 is inserted into the bore hole 12 using the drilling machine 16 which bears against the nut 43 to urge the safety plug 10 at least 150 cm into the bore hole 12. It will, however, be appreciated that the safety plug 10 could be inserted further into the bore hole 12, up to and including abutting to a depth at which the safety plug abuts the proximal end of the stuck drill rod 20.

Figure 18:
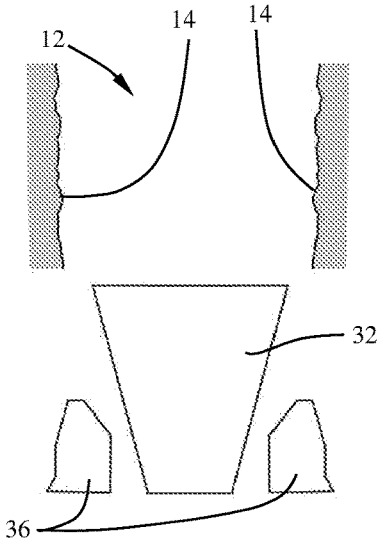
FIG. 18 shows a schematic cross sectional view through the anchoring element and associated flared portion of the safety plug body of FIG. 2, at the following stages of use: (a) prior to installation in a bore hole; (b) during installation in the bore hole; (c) after installation in the bore hole, but prior to impact by a falling drill rod; (d) at a first point in time after impact by a falling drill rod; (e) at a later second point in time after impact by a falling drill rod; and (f) at a third even later point in time after impact by a falling drill rod.
Figure 18:
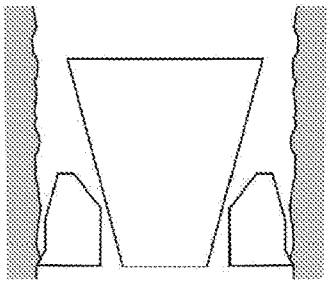
Figure 18:
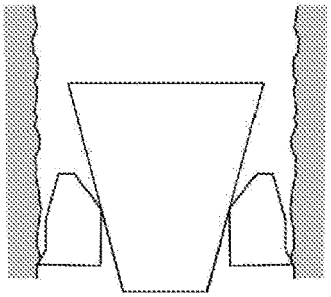
Figure 18:
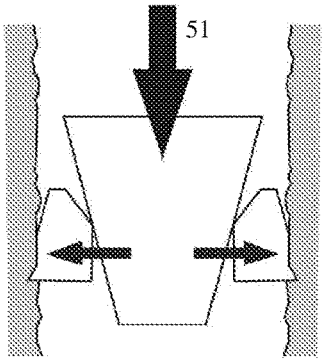
Figure 18:
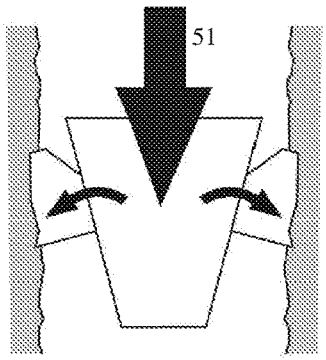
Figure 18:
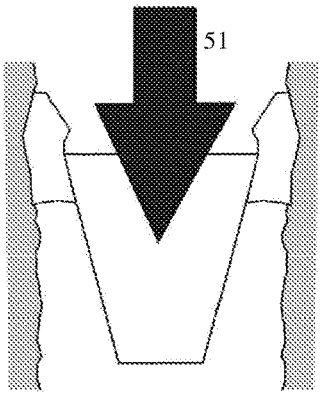

A range of safety plugs 10 is provided, each for bore holes 12 of different diameters. It will be appreciated that a safety plug 10 of appropriate size for a bore hole 12 will have split rings 36 that, in the absence of an external force, have an outer diameter greater than that of bore hole 12. However, the split rings 36 have an inner diameter that is sufficiently greater than that of the trailing end of the flared portions 32 to permit the split rings to be elastically radially compressed to match the diameter of the bore hole 12. Moreover, a safety plug 10 of appropriate size for a bore hole 12 will have flared portions 32 and conical body members 46 that have a diameter less than that of the bore hole 12. After selecting a safety plug 10 of appropriate size, the safety plug 10 is inserted into the bore hole 12 with the split rings 36 and the conical body members 46 in their respective inactive conditions (FIG. 7 and FIGS. 18(*a*) and (*b*)). During insertion, outer surface of each split ring 36 bears against the bore wall 14, causing the split ring to be elastically radially compressed until its outer diameter matches that of the bore hole 12, as shown in FIG. 18(*b*). When the safety plug 10 has been inserted into bore hole 12 to the desired depth, frictional engagement between the outer surface of each split ring 36 and the bore wall 14 retains the safety plug 10 in the bore hole 12, as shown in FIG. 18(*c*).

Response of safety plug 10 to impact by a falling drill rod 20 is shown schematically in FIGS. 11-12 and 18(*d*) to (*f*). When a falling drill rod 20 strikes the leading conical body member 46, the force imparted by the falling drill rod 20 is initially fully transferred to the body 22 of the safety plug 10 due to the conical body members 46 being interlocked by the locking arrangement 52, 54. As a result, the body 22 begins to move in the direction of the bore hole opening (referred to as "proximal movement"). During this proximal movement of the body 22, the flared portions 32 of the body 22 move proximally relative to the split rings 36, due to friction between the split rings 36 and the bore wall 14 being greater than that between the split rings 36 and flared portions 32. As a result, as shown in FIG. 18(*d*), each split ring 36 is displaced closer towards the flared end 34 of its associated flared portion 32, thereby resiliently, radially expanding the split ring 36 and increasing friction between the split rings 36 and the bore wall 14 as well as between each split ring and its associated flared portion 32. Together, frictional engagement of the split rings 36 with the bore wall 14, and between each split ring 36 and its associated flared portion 32, provide an arresting action inhibiting further proximal movement of the body 22 in the bore hole 12.

Further applied force from the falling drill rod 20 is absorbed and dispersed by the conical body members 46 being compressed against the body 22. Locking arrangement 52, 54 is configured to disengage when this compression reaches approximately 50 kg. Following disengagement of locking arrangement 52, 54, the conical body members 46 to transition from their inactive condition, as shown in FIG. 10, to their active, laterally expanded, deformed condition in which they frictionally engage the bore wall 14 as shown by arrow 68 in FIGS. 11 and 12. In so doing, the conical body members 46 dissipate the energy of the falling drill rod 20, initially by elastic deformation and then by plastic deformation, and inhibit imparting of that energy to the body 22 of the safety plug 10. This reduces the risk of the body 22 disengaging from the bore wall 14. Generally, the impact of the falling drill rod will be of sufficient magnitude to cause each split ring 36 to be displaced even closer towards the flared end 34 of its associated flared portion 32, as shown in FIGS. 18(*e*) and (*f*), thereby resiliently, radially expanding the split ring 36 even further and even further increasing friction between the split rings 36 and the bore wall 14 as well as between each split ring and its associated flared portion 32.

Figure 19:
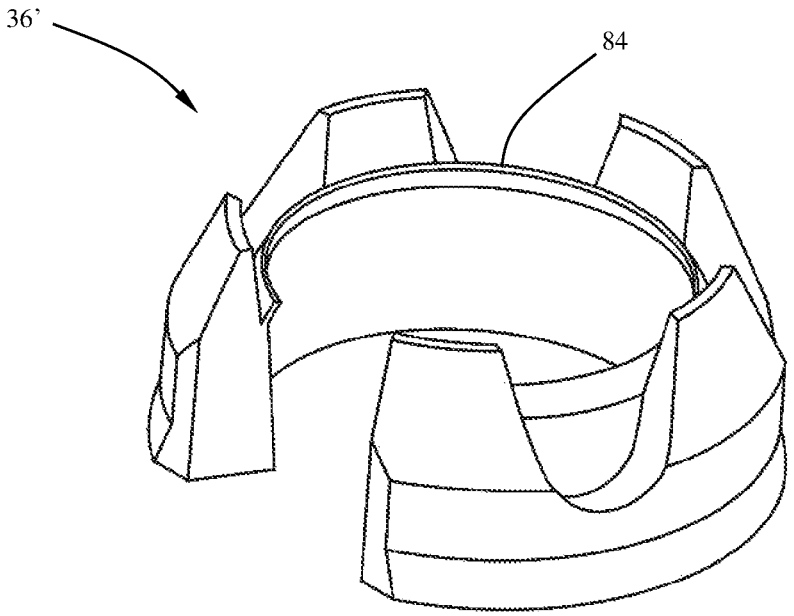
FIG. 19 shows another embodiment of an anchoring element for use with the safety plug body of FIG. 2.

Split ring 36' of FIG. 19 is an alternative embodiment of split ring 36. Split ring 36' includes a locating collar 84 to maintain the split ring 36' coaxial with the associated flared portion 32 during insertion of safety plug 10 into a bore hole 12. Locating collar 84 does not extend across the split of the split ring 36' and is very thin. Typically, locating collar is approximately 0.5 mm thick. Being so thin, locating collar 84 provides substantially no resistance to radial expansion of slat ring 36'. Otherwise, split ring 36' is identical to, and operates in the same manner as, the split ring 36 described above with reference to FIGS. 1-18.

Figure 20:
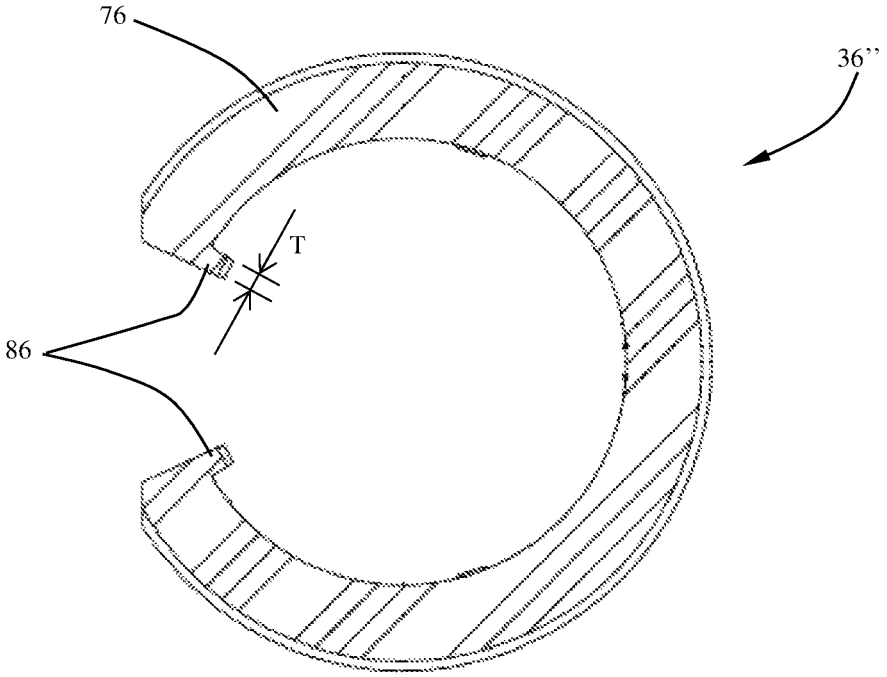
FIG. 20 shows a transverse cross section through the trailing end of a further embodiment of an anchoring element for use with the safety plug body of FIG. 2.

Split ring 36" of FIG. 20 is an alternative embodiment of split ring 36. Split ring 36' includes locating projections 86 extending inwardly from the annular portion 76 adjacent the split of the split ring 36". Projections 86 may be provided only at the trailing end of the annular portion 76 or may extend from the trailing end to the leading end of the annular portion 76. Typically, projections 86 have a thickness T of approximately 2 mm. Projections 86 may assist in retaining split ring 36" on the trailing end of its associated flared portion 32 if the leading end of split ring 36" is impacted during installation of safety plug 10, for example if the leading end of split ring 36" snags on a rim around the entrance to bore hole 12. Split ring 36" may also comprise a locating collar 84 as in split ring 36'. Otherwise, split ring 36" is identical to, and operates in the same manner as, the split ring 36 described above with reference to FIGS. 1-18.

Advantageously, the safety plug 10 aids in arresting movement of the falling drill rod 20 and substantially reduces the likelihood of injuring personnel or damaging equipment in the underground passage 18. The use of a multi-stage process using a combination of frictional engagement and force dissipation via elastic and plastic deformation advantageously increases the likelihood of the safety plug 10 arresting movement of the falling rod 20.

It will also be appreciated that, when mine personnel are aware of the existence of a stuck drill rod, steps have to be taken to protect operating personnel. This results in that area of a mine having to be closed until the stuck drill rod has been dealt with. A safety plug 10 in accordance with the described embodiments of this disclosure assists in rapidly dealing with this problem.

Figure 14:
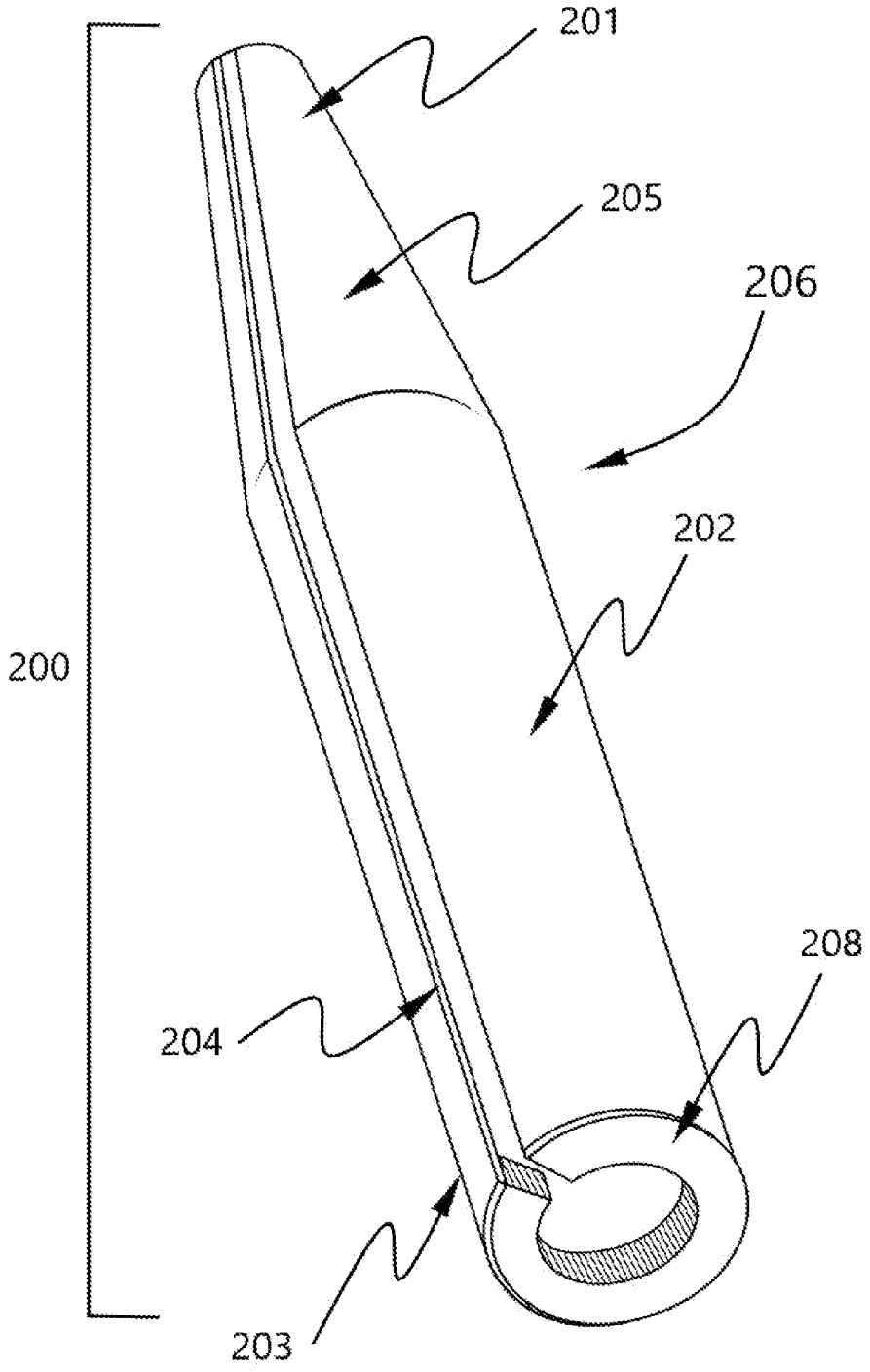
FIG. 14 shows another embodiment of the safety plug.

FIG. 14 shows another embodiment of a safety plug 200 for use in the bore hole 12 comprising the bore wall 14. The safety plug 200 comprises a resiliently deformable body 202 defining a leading end 201 and a trailing end 203, and configured to be fixedly installed in the bore 12 via an interference fit with the bore wall 14. The body 202 includes a tapered section 205 at the leading end 201 and defines an axially extending slot 204 for facilitating a transition from an inactive condition as shown in FIG. 14 to an active, laterally expanded condition (not shown) for engaging the bore wall 14 when a load is applied at the leading end 201. The safety plug 200 also includes a protective element in the form of a collar 208 carried by the trailing end 203 for protecting the body 202 during the insertion of the safety plug 200 into the bore hole 12. Safety plug 200 may be inserted using a normal drilling rig attached to the trailing end 203.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive. Examples of such variations and/or modifications include:

anchoring elements 36 being a closed annulus (i.e., a ring without a split);

crenellations 44 being omitted from anchoring elements 36; and/or safety plug 10 may have a light or light reflector, such as a retroreflector, on its trailing end.

The invention claimed is:

1. A safety plug for use in a bore hole comprising a bore wall, the safety plug comprising:

an elongate body having a leading end and a trailing end, the body comprising at least one flared portion, the at least one flared portion flaring outwardly in a direction from the trailing end to the leading end of the body, the body defining a longitudinal axis extending centrally therethrough between the leading end and the trailing end;

an anchoring element extending at least partially around the least one flared portion of the body, the anchoring element being axially displaceable relative to the flared portion for transitioning the anchoring element, as a result of the anchoring element bearing against the at least one flared portion, between a first condition in which the anchoring element is closer to the longitudinal axis and a second condition in which the anchoring element is expanded relative to the first condition and thereby is further from the longitudinal axis; and a nose extending longitudinally from the leading end of the body, the nose being longitudinally compressible, wherein the at least one flared portion comprises a plurality thereof, the plurality of flared portions being aligned on the longitudinal axis, wherein each of the plurality of flared portions has an associated said anchoring element extending at least partially therearound, wherein the safety plug further comprises a retaining formation proximate the trailing end of the body, the retaining formation abutting the anchoring element associated with the flared portion closest the trailing end to retain that anchoring element in a position forwardly of the retaining formation, wherein, in the absence of an external force acting on the safety plug:

the anchoring elements are in their first condition; and a radial distance from the longitudinal axis to a radially outermost extremity of the anchoring elements is greater than a radial distance from the longitudinal axis to a radially outermost extremity of any other portion of the safety plug.

2. The safety plug of claim 1, in which the nose is longitudinally compressible and laterally expansible.

3. The safety plug of claim 1, wherein abutment of each of the other anchoring elements with a flared end of an adjacent, trailing said flared portion retains each of the other anchoring elements in a position forwardly of its associated adjacent, trailing said flared portion.

4. The safety plug of claim 1, wherein each said anchoring element is a radially expansible annular element.

5. The safety plug of claim 4, wherein each said annular element is a split ring of a resiliently deformable material.

6. The safety plug of claim 4, wherein each said anchoring element comprises crenellations arranged at a leading end thereof.

7. The safety plug of claim 6, wherein the leading end of each of the crenellations is tapered inwardly.

8. The safety plug of claim 6, wherein the crenellations are configured to splay outwardly in response to axial displacement of the anchoring element toward a leading end of the associated flared portion.

9. The safety plug of claim 1, in which the nose is operable to transition between an inactive condition and an active condition to at least partially absorb a force applied to a leading end of the safety plug, a length of the nose being lesser and a width of the nose being greater in the active condition than in the inactive condition.

10. The safety plug of claim 1, wherein the nose comprises a conical body member.

11. The safety plug of claim 10, comprising an axially extending slot in the conical body member to facilitate lateral expansion of the conical body member.

12. The safety plug of claim 10, comprising a plurality of the conical body members, the conical body members being arranged in a nested configuration at the leading end of the body.

13. The safety plug of claim 12, wherein the conical body members have cooperating locking formations for releasably interlocking the plurality of nested conical body members against axial displacement relative to one another.

14. The safety plug of claim 13, wherein the cooperating locking formations are configured to disengage in response to application of a compressive force to the nose.

15. The safety plug of claim 14, wherein, prior to the cooperating locking formations disengaging, each said anchoring element is configured to commence displacement toward a leading end of the associated flared portion in response to the application of the compressive force to the nose.

16. The safety plug of claim 1, wherein, with the anchoring elements restrained against displacement along the longitudinal axis but free to expand laterally, application of a compressive force to the nose initiates expansion of the anchoring elements before initiating compression of the nose.

17. The safety plug of claim 1, wherein each said anchoring element and each said flared portion is of a harder material than the nose.

18. The safety plug of claim 1, wherein each said flared portion is of a plastics material.

19. The safety plug of claim 1, wherein each said anchoring element is of a plastics material.

20. The safety plug of claim 1, wherein the anchoring elements are radially resiliently deformable when in their first condition.

* * * * *